US006992447B2

(12) United States Patent
Fushimi et al.

(10) Patent No.: US 6,992,447 B2
(45) Date of Patent: Jan. 31, 2006

(54) ELECTRON BEAM GENERATION DEVICE HAVING SPACER

(75) Inventors: Masahiro Fushimi, Kanagawa (JP); Jun Iba, Kanagawa (JP); Akira Hayama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 92 days.

(21) Appl. No.: 10/375,194

(22) Filed: Feb. 28, 2003

(65) Prior Publication Data

US 2003/0164686 A1 Sep. 4, 2003

(30) Foreign Application Priority Data

Mar. 4, 2002 (JP) ..... 2002-057289

(51) Int. Cl.
*G09G 3/10* (2006.01)

(52) U.S. Cl. ..... 315/169.3; 315/169.1; 313/497; 313/292; 445/24

(58) Field of Classification Search ..... 315/169.3, 315/169.1; 313/257, 258, 288, 292, 309, 313/336, 497, 500; 345/74.1, 75.2, 76, 92; 445/24, 25

See application file for complete search history.

(56) References Cited

U.S. PATENT DOCUMENTS

| | | | | |
|---|---|---|---|---|
| 4,931,308 A | | 6/1990 | Shimizu et al. | 427/86 |
| 5,455,597 A | * | 10/1995 | Nakamura et al. | 345/74.1 |
| 5,859,502 A | | 1/1999 | Spindt et al. | 315/169.3 |
| 6,342,754 B1 | * | 1/2002 | Kuroda et al. | 313/292 |
| 6,366,014 B1 | * | 4/2002 | Kuroda et al. | 313/495 |
| 6,485,345 B1 | * | 11/2002 | Fushimi | 445/24 |
| 6,494,757 B2 | * | 12/2002 | Yamazaki et al. | 445/24 |
| 6,522,054 B2 | * | 2/2003 | Shibata | 313/310 |
| 6,541,905 B1 | * | 4/2003 | Fushimi et al. | 313/495 |
| 6,604,972 B1 | * | 8/2003 | Yamano | 445/24 |
| 6,677,706 B1 | * | 1/2004 | Hara et al. | 313/496 |
| 6,803,715 B1 | * | 10/2004 | Mitsutake et al. | 313/495 |

FOREIGN PATENT DOCUMENTS

| | | |
|---|---|---|
| EP | 0 869 528 A2 | 10/1998 |
| JP | 57-118355 | 7/1982 |
| JP | 3-49135 | 3/1991 |
| WO | WO 98/02899 | 1/1998 |

OTHER PUBLICATIONS

Ando et al., U.S. Appl. No. 09/722,454, filed Nov. 28, 2000.*

* cited by examiner

*Primary Examiner*—Haissa Philogene
(74) *Attorney, Agent, or Firm*—Fitzpatrick, Cella, Harper & Scinto

(57) ABSTRACT

A technique for correcting an electron trajectory and preventing positional deviation of a light emitting point in an image display apparatus is disclosed. The image display apparatus includes a rear plate which is provided with an electron source having electron-emitting devices, a plurality of wiring electrodes for supplying a drive signal to the electron-emitting devices, a face plate disposed to be opposed to the rear plate and a spacer which is arranged between the face plate and the rear plate and is provided with a spacer electrode on a contact surface which is in contact with the rear plate. And, this image display apparatus is unique in that a distance L1 between a first wiring electrode and a center of a first electron-emitting region and a distance L2 between a second wiring electrode and a center of a second electron-emitting region satisfy a relationship L1>L2.

23 Claims, 12 Drawing Sheets

ELECTRON BEAM GENERATION DEVICE HAVING SPACER

BACKGROUND OF THE INVENTION

1. Field of the Invention

The present invention relates to a device provided with a structure reinforcing member (spacer) in a vacuum container, for example, an electron beam generation device for use in a display apparatus for displaying information such as characters and images, an image-forming apparatus such as an optical printer, and an electron microscope, and the like.

2. Related Background Art

Up to now, two types of electron sources, namely, a thermoelectron source and a cold cathode electron source have been known as electron-emitting devices. Examples of the cold cathode electron source include a field emission device (hereinafter referred to as FE device), a metal/insulator/metal device (hereinafter referred to as MIM device), and a surface conduction electron-emitting device (hereinafter referred to as SCE device).

For example, the surface conduction electron-emitting device has an advantage in that a large number of electron-emitting devices can be formed over a surface of a relatively large area because it is particularly simple in structure and easily manufactured among various cold cathode electron-emitting devices.

In addition, concerning an application of the surface conduction electron-emitting devices, for example, a display apparatus such as a display unit of a video camera or the like, a charged beam source, and the like have been studied.

In general, the above-mentioned display apparatus is provided with a vacuum container including a face plate and a rear plate which are provided to be opposed to each other, and a support frame which is provided so as to hermetically seal external peripheral portions of the face plate and the rear plate. In addition, the vacuum container has a spacer which is arranged in a space between the opposed rear plate and face plate.

A sufficient mechanical strength is required of the spacer in order to support the atmospheric pressure. The spacer should not affect significantly a trajectory of an electron flying between the rear plate and the face plate. Charging of the spacer is one of causes which affect the electron trajectory. It is considered that a part of electrons emitted from an electron source or an electron reflected by the face plate is incident in the spacer and a secondary electron is emitted from the spacer, or ions ionized by collision of electrons deposit on the surface of the spacer, with the result that the charging of the spacer occurs.

In the case in which the spacer is charged positively, since electrons flying in the vicinity of the spacer are attracted to the spacer, distortion occurs on a displayed image in the vicinity of the spacer. Such an influence due to the charging of the spacer becomes more conspicuous in accordance with increase in a space between the rear plate and the face plate.

As a countermeasure for preventing such charging of a spacer, a method of forming an electrode for correcting an electron trajectory in a spacer or removing charges by giving conductivity to a charged surface of the spacer and causing a faint electric current to flow to the spacer is possible.

Further, the method of giving conductivity to a charged surface of a spacer is applied to a spacer. JP 57-118355 A discloses a technique for coating a surface of a spacer with tin oxide. In addition, JP 03-49135 A discloses a technique for coating a surface of a spacer with a PdO glass material.

In addition, with a spacer electrode being provided in a contacting portion with a face plate or a rear plate, breakage of a spacer due to connection failure or concentration of electric currents can be prevented by applying an electric field to the above-mentioned coating material uniformly.

Moreover, EP 869528 discloses that a potential distribution in the vicinity of a spacer is controlled according to a shape of a spacer electrode and, as a result, a trajectory of electron beams can be controlled.

In the above-mentioned conventional examples, an electrode for correcting an electron trajectory in the spacer is formed or a high resistance film is formed on the surface of the spacer to neutralize positive charging, whereby charging can be relaxed to prevent electrons flying in the vicinity of a spacer from being attracted by the spacer.

However, charging may not be removed completely depending upon a device pitch, drive conditions, or the like, or it may be preferable not to give conductivity to a charged surface of a spacer taking into account mass production. Therefore, there have been demands for a satisfactory image display apparatus which can cope with such situations.

SUMMARY OF THE INVENTION

In order to solve the above-mentioned problems inherent in the prior art, an image display apparatus according to the present invention comprises:

a first substrate provided with an electron source which has a plurality of electron-emitting devices each having an electron-emitting region and a plurality of wiring electrodes for supplying a drive signal to the electron-emitting devices, the electron-emitting regions being arranged so as to have a substantially equal space with respect to each other; a second substrate disposed to be opposed to the first substrate and having an acceleration electrode to which an acceleration voltage is applied and on which the electrons emitted from the electron-emitting regions arrive, the acceleration voltage acting on the emitted electrons to accelerate them; and, one or more spacers disposed between the first substrate and the second substrate, the spacers being disposed on some of the plurality of wiring electrodes. And, this image display apparatus is unique in that spaces among the plurality of wiring electrodes are partially varied so that the electrons emitted from each of the electron-emitting regions in the electron-emitting devices arrive at a region on the acceleration electrodes, which is positioned substantially right above that electron-emitting region.

In a first aspect of the present invention's image display apparatus, to appropriately vary the spaces among the wiring electrodes, a wiring electrode on which the spacer is disposed is assumed to be a first wiring electrode, a wiring electrode adjacent to the first wiring electrode is assumed to be a second wiring electrode, and a wiring electrode adjacent to the second wiring electrode in a direction apart from the spacer is assumed to be a third wiring electrode, a space W1 between the first wiring electrode and the second wiring electrode and a space W2 between the second wiring electrode and the third wiring electrode satisfy a relationship W1>W2.

In a second aspect of the present invention's apparatus, when a wiring electrode on which the spacer is disposed is assumed to be a first wiring electrode, an electron-emitting region adjacent to the first wiring electrode is assumed to be a first electron-emitting region, a wiring electrode adjacent to the first wiring electrode is assumed to be a second wiring electrode, and an electron-emitting region adjacent to the second wiring electrode in a direction apart from the spacer is assumed to be a second electron-emitting region, the spaces among the plurality of wiring electrodes are partially varied such a manner that a distance L1 between the first wiring electrode and a center of the first electron-emitting region and a distance L2 between the second wiring electrode and a center of the second electron-emitting region satisfy a relationship L1>L2.

In a third aspect of the present invention's apparatus, when a wiring electrode on which the spacer is disposed is assumed to be a first wiring electrode, an electron-emitting region adjacent to the first wiring electrode is assumed to be a first electron-emitting region, a wiring electrode adjacent to the first wiring electrode is assumed to be a second wiring electrode, and an electron-emitting region adjacent to the second wiring electrode in a direction apart from the spacer is assumed to be a second electron-emitting region, the spaces among the plurality of wiring electrodes are partially varied such a manner that a distance S1 between the second wiring electrode and a center of the first electron-emitting region and a distance L2 between the second wiring electrode and a center of the second electron-emitting region satisfy a relationship S1>L2.

In a fourth aspect of the present invention's apparatus, when a wiring electrode on which the spacer is disposed is assumed to be a first wiring electrode, an electron-emitting region adjacent to the first wiring electrode is assumed to be a first electron-emitting region, a wiring electrode adjacent to the first wiring electrode is assumed to be a second wiring electrode, an electron-emitting region adjacent to the second wiring electrode in a direction apart from the spacer is assumed to be a second electron-emitting region, and a wiring electrode adjacent to the second wiring electrode in a direction apart from the spacer is assumed to be a third wiring electrode, the spaces among the plurality of wiring electrodes are partially varied such a manner that a distance L2 between the second wiring electrode and a center of the second electron-emitting region and a distance S2 between the third wiring electrode and a center of the second electron-emitting region satisfy a relationship L2<S2.

In the present invention's image display apparatus, it is preferable that a width of the second wiring electrode is larger than a width of the first wiring electrode.

And, preferably, the plurality of electron-emitting devices are surface conduction electron-emitting devices that are provided with a pair of device electrodes opposed to each other and a thin film which has an electron-emitting region and is provided between the device electrodes.

Further, it is more preferable that a plurality of row-directional wirings and column-directional wirings for supplying an electric current to the device electrodes are disposed on the electron source via an insulating layers, and the pair of device electrodes are connected to the row-directional wirings and the column-directional wirings, whereby the plurality of electron-emitting devices are arranged in a matrix shape on an insulating substrate.

According to the image display apparatus of the present invention, since a potential distribution around the electron-emitting region can be controlled in a portion closer to the electron-emitting region, emitted electrons are less likely to be affected by a potential distribution on the spacer surface, and constant correction of a repulsion direction is applied to an electron trajectory. As a result, an electron emitted from the second electron-emitting region can reach a position substantially right above the electron-emitting region through the corrected electron trajectory. Therefore, even in the vicinity of the spacer, positional deviation of a light emitting point (beam spot) to be formed by the reaching electron is suppressed.

In addition, according to the technical thought of the present invention, the present invention is not limited to the display apparatus which is preferable for displaying characters and images. The above-mentioned structure can also be used as an alternative light emitting source such as a light emitting diode or the like of an optical printer which is constituted by a photosensitive drum, the light emitting diode, and the like. In addition, when the above-mentioned structure is used as the light emitting source, it can be used not only as a light emitting source of a line arrangement shape but also as a light emitting source of a two-dimensional shape by appropriately selecting the above-mentioned m row-directional wirings and n column-directional wirings. In this case, a display member is not limited to a material which directly emits light such as a phosphor which is used in a display apparatus of an embodiment discussed later. A member on which a latent image formed by charging of electrons is displayed can also be used.

Note that, according to the technical thought of the present invention, the present invention can also be applied to the case in which a member to be irradiated by electrons emitted from an electron source is a member other than a display member such as a phosphor, for example, as in an electron microscope. Therefore, the present invention takes a form as a general electron beam generation device in which a member to be irradiated by electrons is not specified.

DESCRIPTION OF THE PREFERRED EMBODIMENTS

Here, distortion of an electron beam trajectory in the vicinity of a spacer in a vacuum container of a display apparatus, which is a problem to be solved by the present invention, will be described.

Figure 14:
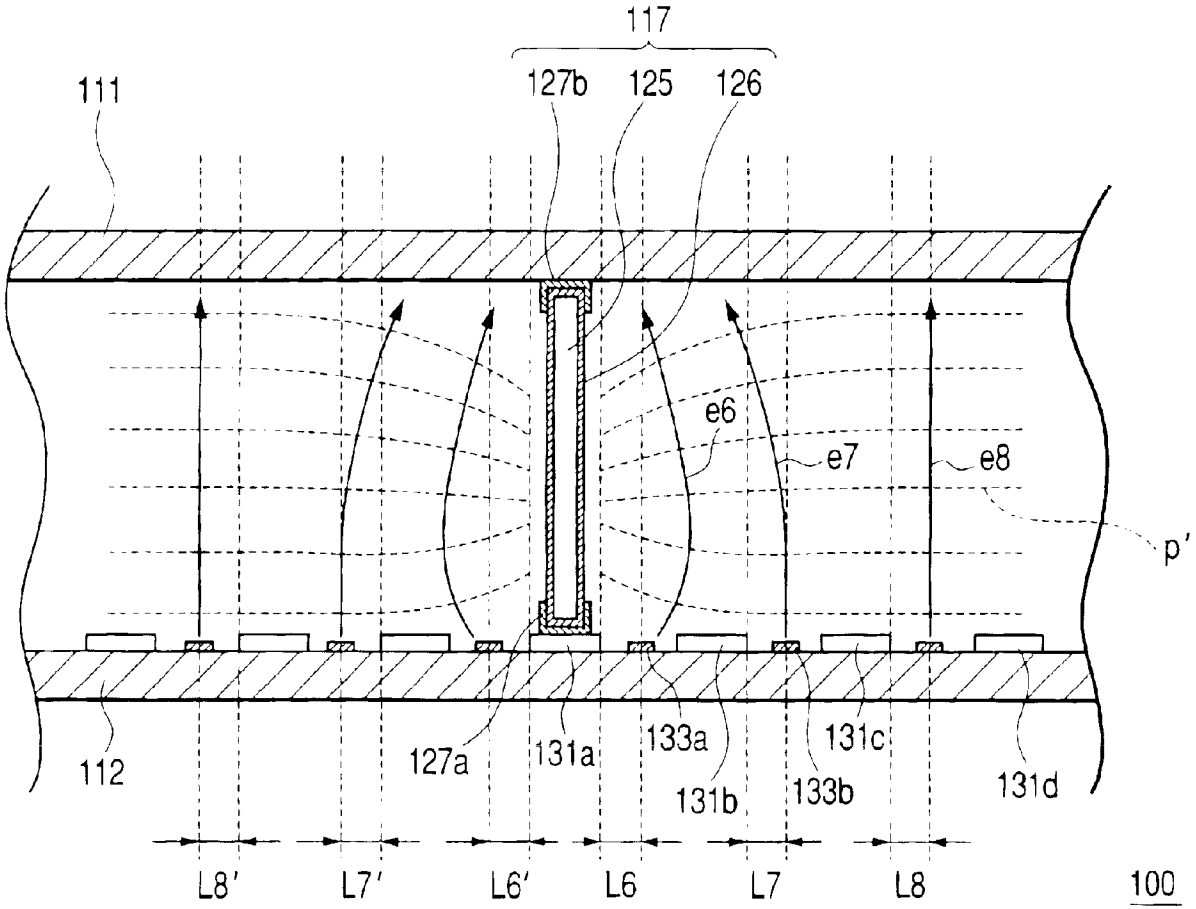
FIG. 14 is a sectional view for explaining portions in the vicinity of a spacer of a conventional display apparatus.

As shown in FIG. 14, a vacuum container 100 included in a display apparatus is provided with a face plate 111, a rear plate 112 which is provided in a position opposed to the face plate 111, and a support frame (not shown) which is provided so as to hermetically seal external peripheral portions of the face plate 111 and the rear plate 112. In addition, in the vacuum container 100, a spacer 117 is provided in a space between the opposed face plate 111 and rear plate 112.

The spacer 117 is constituted by forming a high resistance film 126 for preventing charging on a surface of an insulating member 125. In addition, in the spacer 117, spacer electrodes 127*a* and 127*b* for electrically connecting the spacer 117 to the face plate 111 and the rear plate 112 are formed and provided, respectively, on contact surfaces over the high resistance film 126.

In addition, a first wiring electrode 131*a* with which the spacer electrode 127*a* of the spacer 117 is made in contact is provided on a surface of the rear plate 112. A second wiring electrode 131*b*, a third wiring electrode 131*c*, and a fourth wiring electrode 131d are arranged thereon, respectively, in order toward the side spaced apart from the spacer 117. Further, a first electron-emitting region 133*a* is provided on the rear plate 112 in a position adjacent to the first wiring electrode 131*a*. A second electron-emitting region 133*b* and a third electron-emitting region 133*c* are arranged thereon between the two adjacent wiring electrodes 131, respectively, in order toward the side spaced apart from the spacer 117.

In addition, arrows in the figure indicate electron trajectories e6, e7, and e8, respectively, and broken lines nearly parallel with the face plate 111 and the rear plate 112 indicate equipotential lines p.

Further, a distance between a side end of the first wiring electrode 131*a* and a center of the first electron-emitting region 133*a* is assumed to be L6, a distance between a side end of the second wiring electrode 131*b* and a center of the second electron-emitting region 133*b* is assumed to be L7, and a distance between a side end of the third wiring electrode 131*c* and a center of the third electron-emitting region 133*c* is assumed to be L8. In addition, distances equal to the above-mentioned distances L6, L7, and L8 are assumed to be L6', L7', and L8', respectively, both of which are symmetrical with respect to the spacer 117.

Note that, in FIG. 14, all of the distances L6, L7, and L8 and the distances L6', L7', and L8' are the same.

As shown in FIG. 14, the spacer electrode 127*a* on the rear plate 112 side can cause the electron trajectory e6 to repel by changing an electric field in the space. In addition, the electron trajectory e6 is affected by the charging of the spacer 117 or affected by the spacer electrode 127*b* on the face plate 111 side, thereby being attracted to the spacer 117 side.

In addition, an electron trajectory e7 of an electron emitted from the second electron-emitting region 133*b* is less likely to be affected by the spacer electrode 127*a* on the rear plate 112 side. However, it is affected by the charging of the spacer 117 or affected by the spacer electrode 127*b* on the face plate 112 side, thereby being attracted to the spacer 117 side.

It is confirmed that the phenomenon, in which the trajectory of the electron emitted from the electron-emitting device adjacent to the spacer is repelled from the spacer on its rear plate side and greatly attracted to the spacer on its face plate side, may take place not only in the vicinity of the spacer having the above spacer electrodes 127*a*, 127*b*, but also even in the vicinity of the spacer free from the spacer electrodes. The reason, why this phenomenon takes place even in the vicinity of the spacer free from the spacer electrodes, resides in that a charging state of the spacer partially varies depending on whether it is on the face plate side or rear plate side. And, the partial variation of the charging state of the spacer results from that reflected electrons yielded on the face plate are irradiated to the spacer. Specifically, there are yielded many positive charges at a part of the face plate side of the spacer because many reflected electrons are irradiated to this part of the spacer with relatively higher energy. On the other hand, there are yielded negative charges at a part of the spacer adjacent to the rear plate because the reflected electrons are irradiated to this part of the spacer with relatively lower energy. As a result, the trajectory of the electron emitted from the electron-emitting device is greatly changed at the part of the face plate side of the spacer and at the part thereof adjacent to the rear plate. In short, the above phenomenon is caused by using the spacer in which a change in electric field occurring on the face plate side of the spacer (a change in electric field acting so as to attract an electron beam) is greater than a change in electric field occurring on the rear plate side thereof (a change of electric field acting so as to repel the electron beam), these changes in electric field being caused by various factors such as a driving condition and a structure of the vacuum container.

In this way, positional deviation may occur in a reaching position of an electron beam emitted from one of the first electron-emitting region 133*a* adjacent to the spacer 117 and the second electron-emitting region 133*b* adjacent to the first electron-emitting region 133*a* (light emitting point). Therefore, the conventional display apparatus has a problem in that distortion occurs in a displayed image or the like.

Thus, it is an object of the present invention to provide an electron beam generation device which is capable of correcting an electron trajectory to prevent positional deviation from occurring in a light emitting point.

As to specific embodiments of the present invention, a flat display apparatus will be hereinafter described with reference to the accompanying drawings.

First Embodiment

Figure 1:
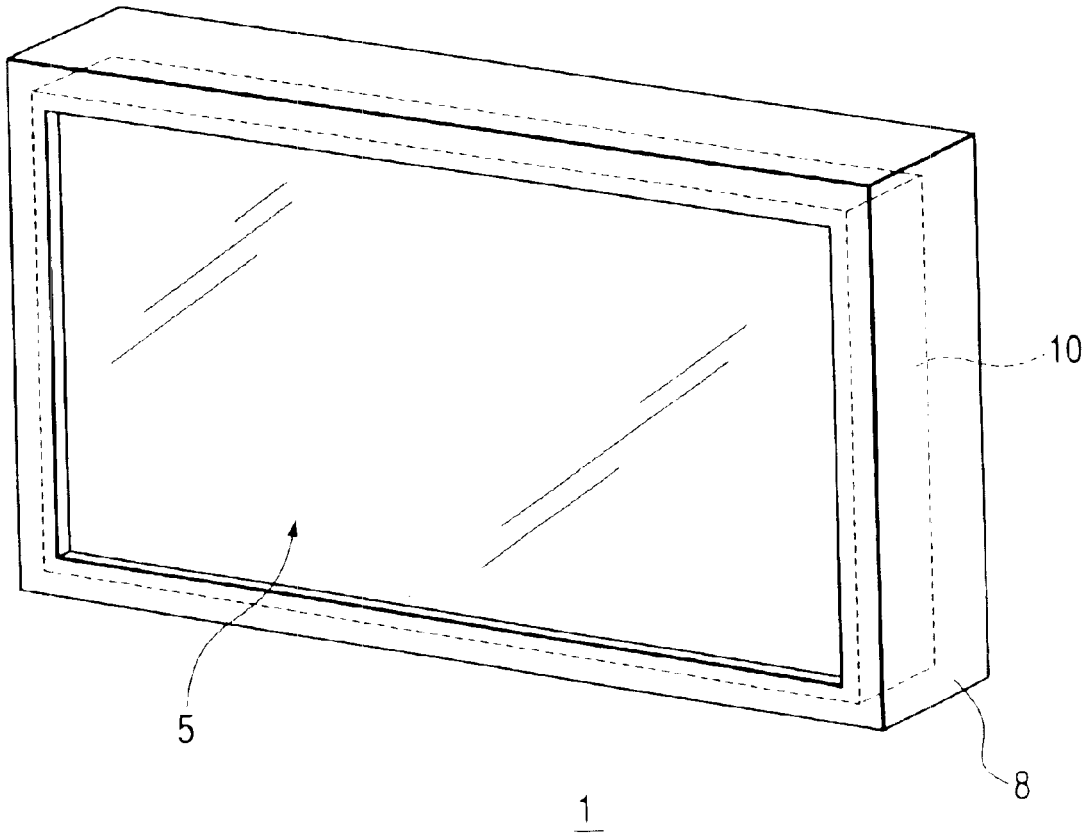
FIG. 1 is a perspective view showing a display apparatus in accordance with the present invention.
Figure 6:
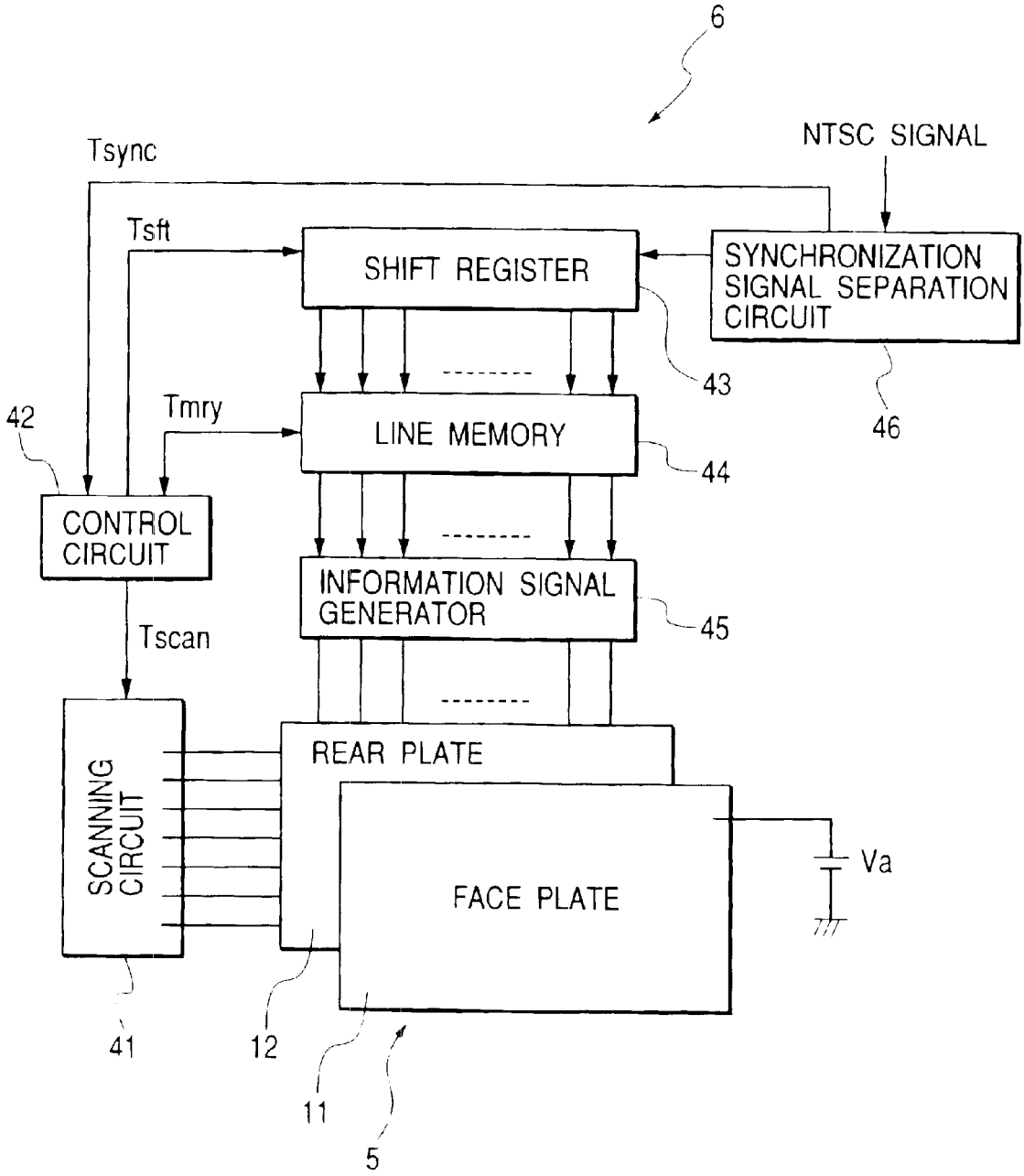
FIG. 6 is a block diagram for explaining a driving control section.

As shown in FIG. 1, a display apparatus 1 has a display unit 5 that displays various kinds of information such as characters and images. In addition, as shown in FIG. 6, the display apparatus 1 includes a control section 6 that controls the drive of the display unit 5, a support frame (not shown) that supports the display unit 5 and the control section 6, and a cover 8 serving as an external housing for covering the control section 6 and the support frame.

Figure 2:
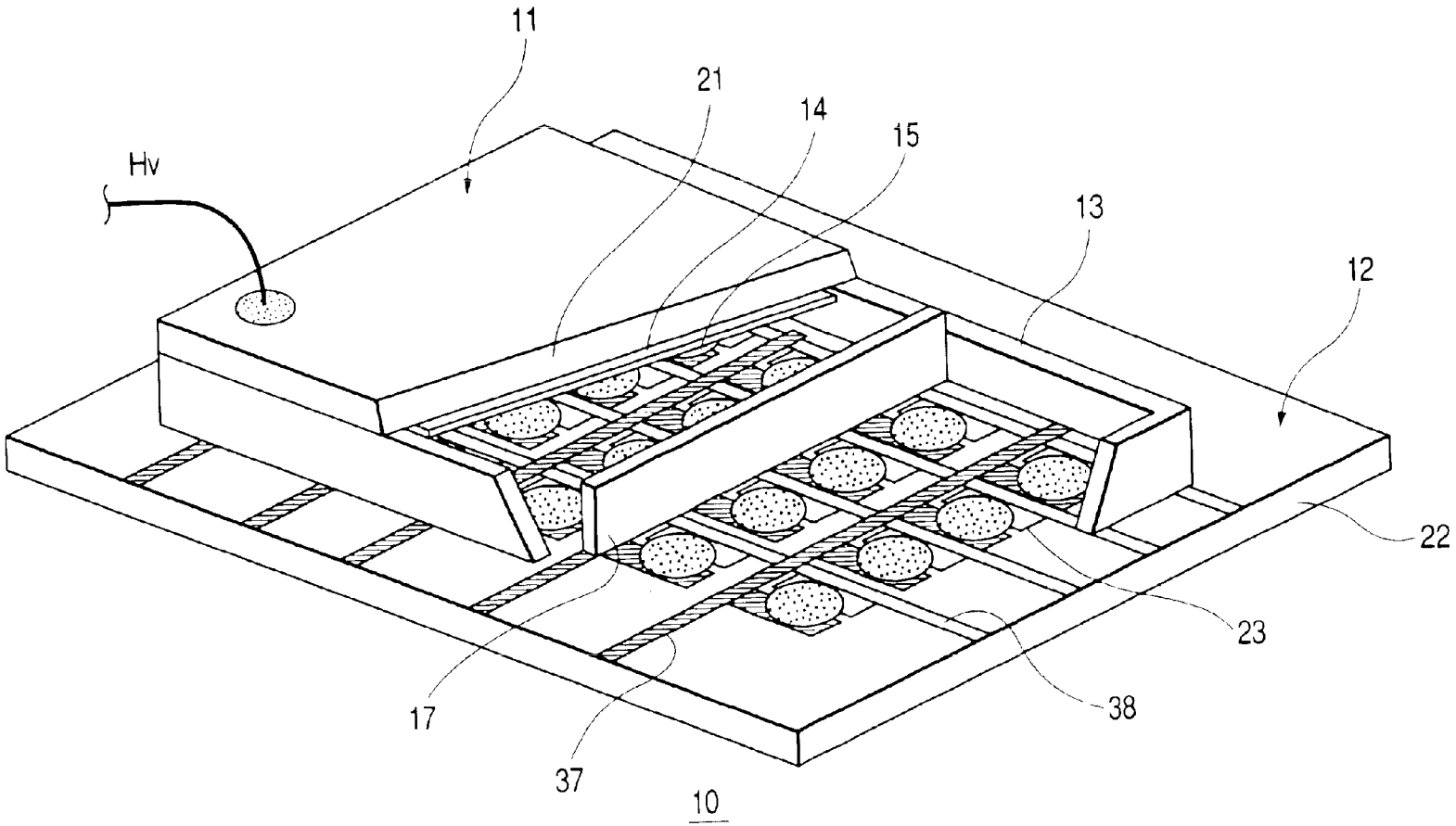
FIG. 2 is a perspective view showing a vacuum container with a part of it cut out.

As shown in FIG. 2, the display unit 5 has a vacuum container 10, inside of which is maintained vacuum, and a voltage applying section (not shown) that supplies a voltage into the vacuum container 10.

The vacuum container 10 is provided with a face plate 11, a rear plate 12 which is provided in a position opposed to the face plate 11, and a support frame 13 which is provided so as to hermetically seal the external peripheral portion of the face plate 11 of the rear plate 12.

The face plate 11 is provided with a glass substrate 21 consisting of a glass material, a fluorescent film 14, which is provided on a surface opposed to the rear plate 12 of the glass substrate 21, and a metal back 15 formed on the fluorescent film 14.

On the rear plate 12, there are provided a glass substrate 22 consisting of a glass material, a plurality of electron-emitting devices 23, which are regularly arranged on a surface of the glass substrate 22 opposed to the face plate 11, and a plurality of wiring electrodes 37 and 38 that supplies a drive signal to the electron-emitting devices 23. As the electron-emitting devices 23, for example, a surface conduction electron-emitting device can be used. In this embodiment, the surface conduction electron-emitting device is used.

Further, in the vacuum container 10, a space surrounded by the face plate 11, the rear plate 12, and the support frame 13 is maintained vacuum on the order of $10^{-4}$ Pa. Thus, the vacuum container 10 is provided with a spacer 17 serving as a structure reinforcing member for reinforcing mechanical strength of the vacuum container 10 in order to prevent the face plate 11 and the rear plate 12 from being deformed by a pressure difference between the external atmospheric pressure and the pressure in the vacuum container 10 in the case in which the display surface has a relatively large area. The spacer 17 is formed in a rectangular and substantially thin plate shape and is provided in a position between the face plate 11 and the rear plate 12.

Figure 3B:
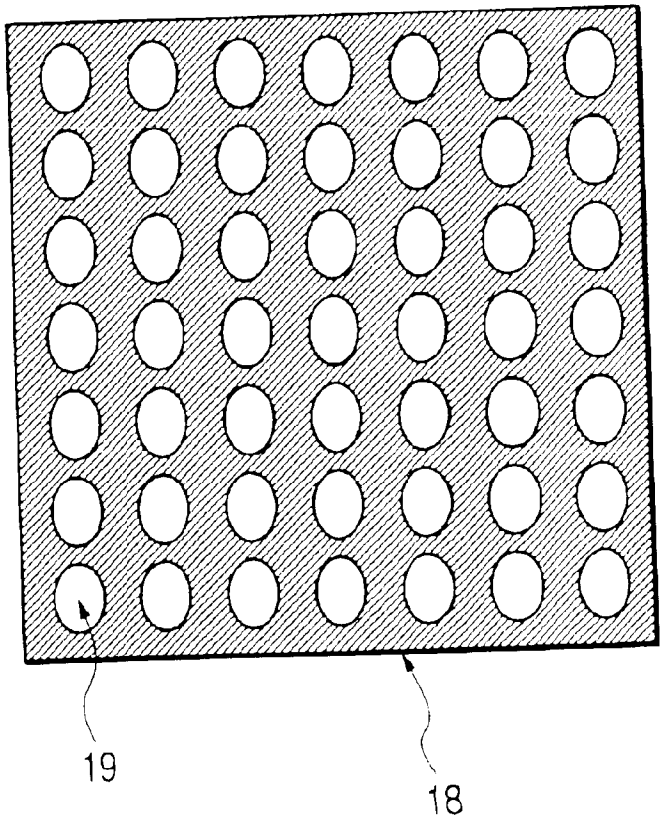
FIGS. 3A and 3B are plan views showing fluorescent films to be provided on a face plate.
Figure 3A:
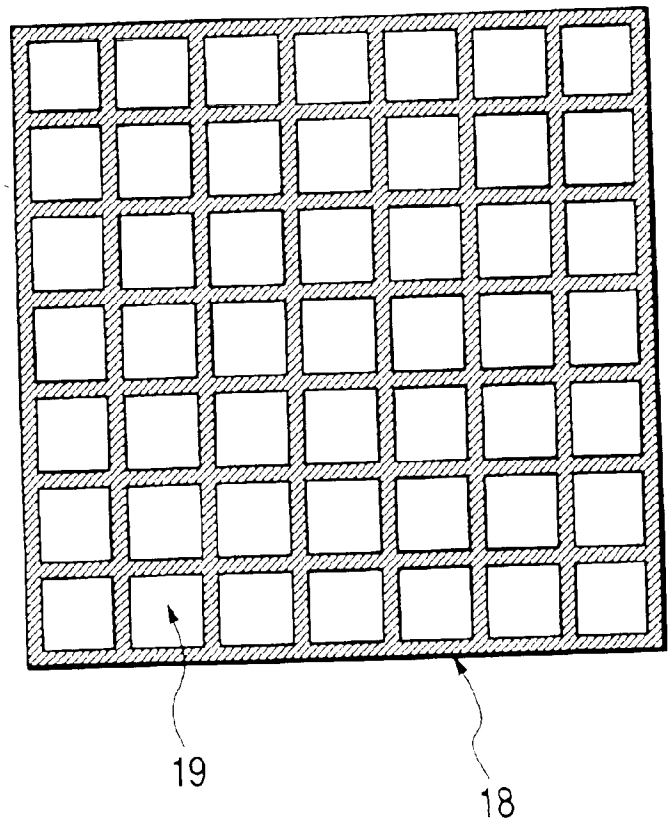

First, the fluorescent film 14 of the face plate 11 will be described with reference to the drawings. FIGS. 3A and 3B show plan views for explaining an example of a fluorescent film to be provided on the face plate 11. In the case of monochrome display, the fluorescent film 14 consists only of phosphors. However, in the case of color display, for example, as shown in FIGS. 3A and 3B, the fluorescent film 14 is constituted by a black conductive body 18, which is referred to as a black stripe, a black matrix, or the like according to an arrangement of phosphors, and phosphors 19.

In addition, usually, the metal back 15 is provided on the internal surface of the fluorescent film 14. The metal back 15 is provided for the purposes of mirror-reflecting lights travelling to the internal surface side among emitted lights of the phosphors to the face plate 11 side, thereby increasing a luminance, acting as an anode electrode that applies an acceleration voltage of electron beams, and the like.

When the above-mentioned vacuum container 10 is sealed, in the case of color display, the phosphors of respective colors and the electron-emitting devices 23 are required to be associated with one another. Thus, it is necessary to appropriately position the face plate 11 and the rear plate 12 by bumping them against a reference position or by some other means.

As a degree of vacuum at the time of sealing, a vacuum on the order of $10^{-7}$ Torr is required. In addition, getter processing may be performed in order to maintain a vacuum of the vacuum container 10 after sealing.

Figure 5:
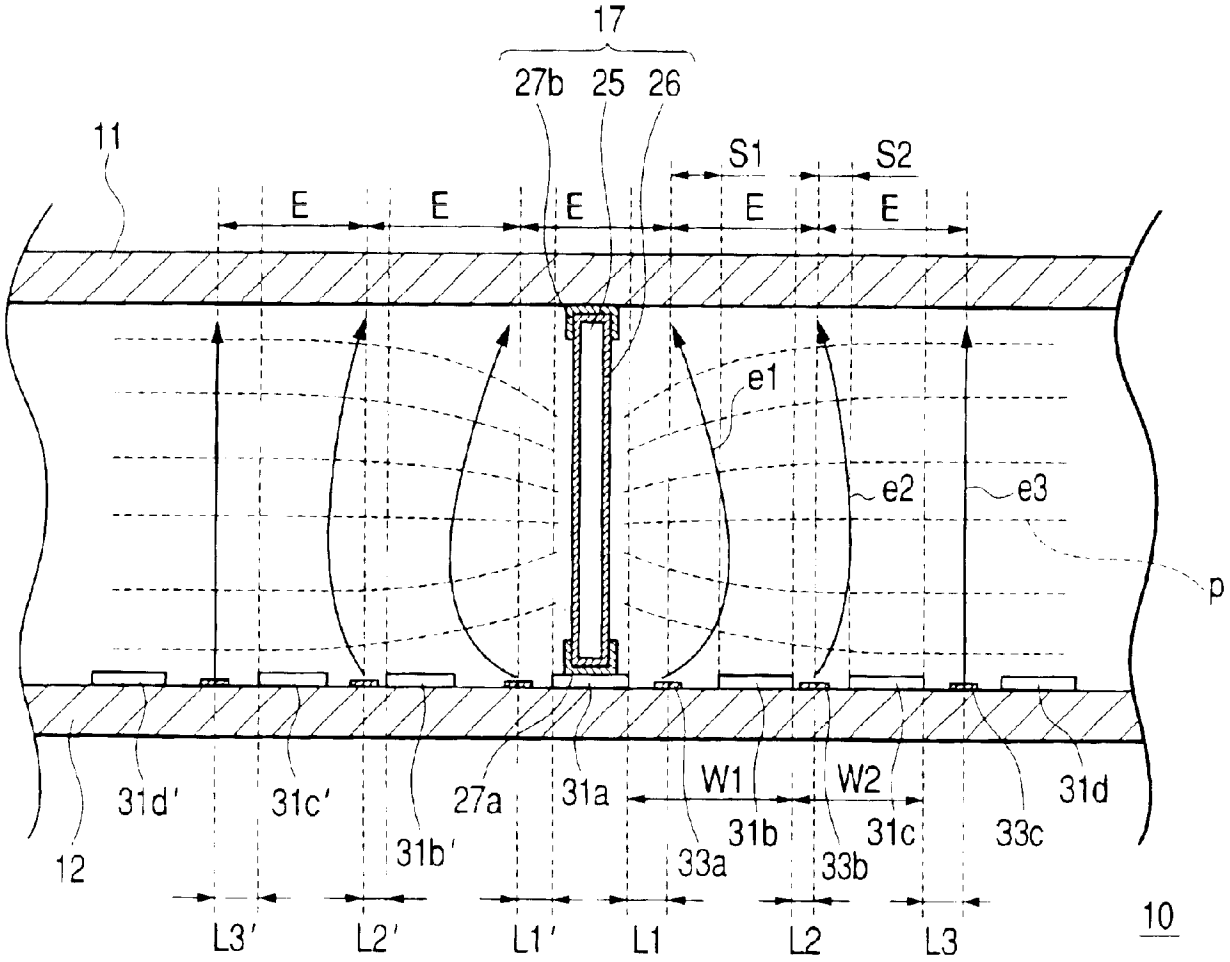
FIG. 5 is a sectional view for explaining a wiring electrode and an electron emitting section in the vicinity of a spacer.

As to the vacuum container 10 provided in the display apparatus 1 of this embodiment, the spacer 17 and the electron-emitting devices 23 will be described in more detail with reference to the drawings. FIG. 5 shows a schematic sectional view of the vacuum container 10.

As shown in FIG. 5, the spacer 17 is constituted by forming a high resistance film 26 for preventing charging on a surface of an insulating member 25. In addition, in the spacer 17, spacer electrodes 27*a* and 27*b* for electrically connecting the spacer 17 to the face plate 11 and the rear plate 12 are formed and provided, respectively on contact surfaces over the high resistance film 26. In addition, of the surface of the insulating member 25, the high resistance film 26 is formed at least on a surface exposed to the vacuum in the vacuum container 10.

Further, in the vacuum container 10, a desired number of spacers 17 are arranged at a desired space and are fixed between the face plate 11 and the rear plate 12. The spacers 17 are electrically connected to the metal back 15 on the face plate 11 and to a first wiring electrode 31*a* on the rear plate 12 via the spacer electrodes 27*a* and 27*b*.

In addition, as shown in FIG. 5, the first wiring electrode 31*a* with which the spacer electrode 27*a* of the spacer 17 is in contact is provided on the rear plate 12. A second wiring electrode 31*b*, a third wiring electrode 31*c*, and a fourth wiring electrode 31*d* are arranged thereon, respectively, in an order toward the side spaced apart from the spacer 17. Further, a first electron-emitting region 33*a* is provided on the rear plate 12 in a position adjacent to the first wiring electrode 31*a*. A second electron-emitting region 33*b* and a third electron-emitting region 33*c* are arranged thereon between the two adjacent wiring electrodes 31, respectively, in an order toward the side spaced apart from the spacer 17.

In addition, in FIG. 5, arrows indicate electron trajectories e1, e2, and e3, respectively, and broken lines nearly parallel with the face plate 11 and the rear plate 12 indicate equipotential lines p.

Further, a distance between a side end of the first wiring electrode 31*a* and a center of the first electron-emitting region 33*a* is assumed to be L1, a distance between a side end of the second wiring electrode 31*b* and a center of the second electron-emitting region 33*b* is assumed to be L2, and a distance between a side end of the third wiring electrode 31*c* and a center of the third electron-emitting region 33*c* is assumed to be L3. In addition, distances equal to the above-mentioned distances L1, L2, and L3 are assumed to be L1', L2', and L3', respectively, both of which are symmetrical with respect to the spacer 17. Note that each of the above-mentioned distances L indicates a linear distance which is parallel with the main surface of the rear plate 12 and is on the cross section of the rear plate 12. In addition, a device pitch E is substantially equal between any adjacent two devices. Inter-wiring pitches W1 and W2 establish a relationship W1>W2.

In this way, the second wiring electrode 31*b* is formed adjacent to the second electron-emitting region 33*b*, whereby the distances L1 and L2 satisfy a relationship of the following expression:

$$L1>L2 \qquad \text{Expression 1}$$

In addition, the distances L1 and L3 satisfy a relationship L3=L1. Note that distances L between the centers of the other electron-emitting regions 33 and the other wiring electrodes 31 are equal to the distance L1 in the portions other than the vicinity of the spacer 17.

This is because the electron trajectory e2 is set to the repulsion direction by arranging the second wiring electrode 31*b* close to the second electron-emitting region 33*b*. As a result, an electron emitted from the second electron-emitting region 33*b* can reach a position substantially directly above the second electron-emitting region 33*b* through the electron trajectory e2. Therefore, even in the vicinity of the spacer 17, positional deviation of a light emitting point (beam spot) to be formed by the reaching electron is suppressed.

Note that the distance L2 cannot be determined unconditionally because it relates to various conditions such as pitches of device electrodes 35 and 36, characteristics of the spacer 17, drive conditions, a thickness of the wiring electrodes 31, a space between the opposed face plate 11 and rear plate 12, and the like. However, the distance L2 is set to approximately 98% to 50% of the distance L1, and particularly preferably to 95% to 75%. In addition, in this embodiment, when a distance between the second wiring electrode 31*b* and the center of the first electron-emitting region 33*a* is assumed to be S1 and a distance between the second wiring electrode 31*b* and the center of the second electron-emitting region 33*b* is assumed to be L2, a relationship S1>L2 is also satisfied simultaneously. Moreover, a relationship L2<S2 is also satisfied for the distance L2 between the second wiring electrode 31*b* and the center of the second electron-emitting region 33*b* and a distance S2 between the third wiring electrode 31*c* and the center of the second electron-emitting region 33*c*. In this embodiment, a form satisfying all the above-mentioned conditions is a particularly preferable form. However, sufficient effects can be obtained with a form satisfying a part of the conditions. As an example of the form satisfying a part of the conditions, there is the case in which electron-emitting devices are arranged only in one side of a spacer. In this case, a wiring space only has to be determined so as to satisfy particular conditions.

In addition, the spacer 17 is required to have an insulating property for allowing the spacer 17 to withstand a high voltage applied between the wiring electrode 31*a* on the rear plate 12 and the metal back 15 of the face plate 11 and, at the same time, to have a conductivity which is enough for preventing charging to the surface of the spacer 17.

Examples of the insulating member 25 of the spacer 17 include quarts glass, glass from which a content of impurities such as Na is reduced or eliminated, soda lime glass, and a ceramic member such as alumna. Note that, as the insulating member 25, a material is preferable which has a coefficient of thermal expansion which is close to that of a material forming the vacuum container 10 and the rear plate 12.

An electric current, which is found by dividing an acceleration voltage Va applied to the face plate 11 on the high potential side by a resistance value Rs of the high resistance film 26 serving as a charging prevention film, is flown to the high resistance film 26 constituting the spacer 17. Thus, the resistance value Rs of the spacer 17 is set to a desirable range taking into account prevention of charging and electric power consumption. From the viewpoint of the prevention of charging, a surface resistance R/□ is preferably $10^{14}$ Ω/□ or less. In addition, the surface resistance R/□ is more preferably $10^{13}$ Ω/□ or less in order to obtain a sufficient charging prevention effect. A lower limit of the surface resistance R/□ is preferably $10^{7}$ Ω/□ or more although it depends upon a shape of the spacer 17 and a voltage applied between the spacer electrodes 27*a* and 27*b*.

In addition, a not-shown charging prevention film is formed on the insulating member 25. A thickness t of this charging prevention film is desirably in a range of 10 nm to 50 μm. In general, in the case in which the film thickness t is 10 nm or less, a high resistance film is unstable in resistance and poor in reproducibility because it is formed in a substantially island shape although it depends upon a surface energy of a material, adhesion with the insulating member 25, and a temperature of the insulating member 25. In the case in which the film thickness t is 50 μm or more, it is more likely that the insulating member 25 is deformed in a forming process of the high resistance film.

Assuming that a resistivity of the high resistance film is ρ, since the surface resistance R/□ is ρ/t, the resistivity p of the high resistance film is preferably in a range of 10 Ωcm to $2^{10}$ Ωcm judging from the above-mentioned preferable ranges of the surface resistance R/□ and the film thickness t. Moreover, in order to realize the preferable ranges of the surface resistance R/□ and the film thickness t, it is better to set the resistivity ρ to a range of $10^{4}$ to $10^{8}$ Ωcm.

As a material of the high resistance film 26 having the charging prevention characteristic, for example, metal oxides can be used. Among the metal oxides, for example, oxides of chromium, nickel, and copper are preferable materials. This is because, these oxides have a relatively low emission efficiency of a secondary electron and are hardly charged even if an electron emitted from the electron-emitting region 33 collides against the spacer 17. As a material other than the metal oxides, carbon is preferable because it has a low emission efficiency of a secondary electron. In particular, amorphous carbon is preferable because it has a high resistance and a resistance of the spacer 17 is easily controlled to a desired value if the high resistance film 26 is made of amorphous carbon.

As another material of the high resistance film 26 having the charging prevention characteristic, a nitride of aluminum and transition metal alloy are preferable because a resistance value of them can be controlled in a wide range from that of a highly conductive body to that of an insulating body by adjusting a composition of the transition metal. Moreover, such a nitride has a relatively small variation of a resistance value in a manufacturing process of a display apparatus discussed later and is a stable material. In addition, a nitride has a temperature coefficient of resistance larger than (−) 1% and is a material which is practically easy to use. Examples of a transition metal element include Ti, Cr, and Ta.

Figure 4:
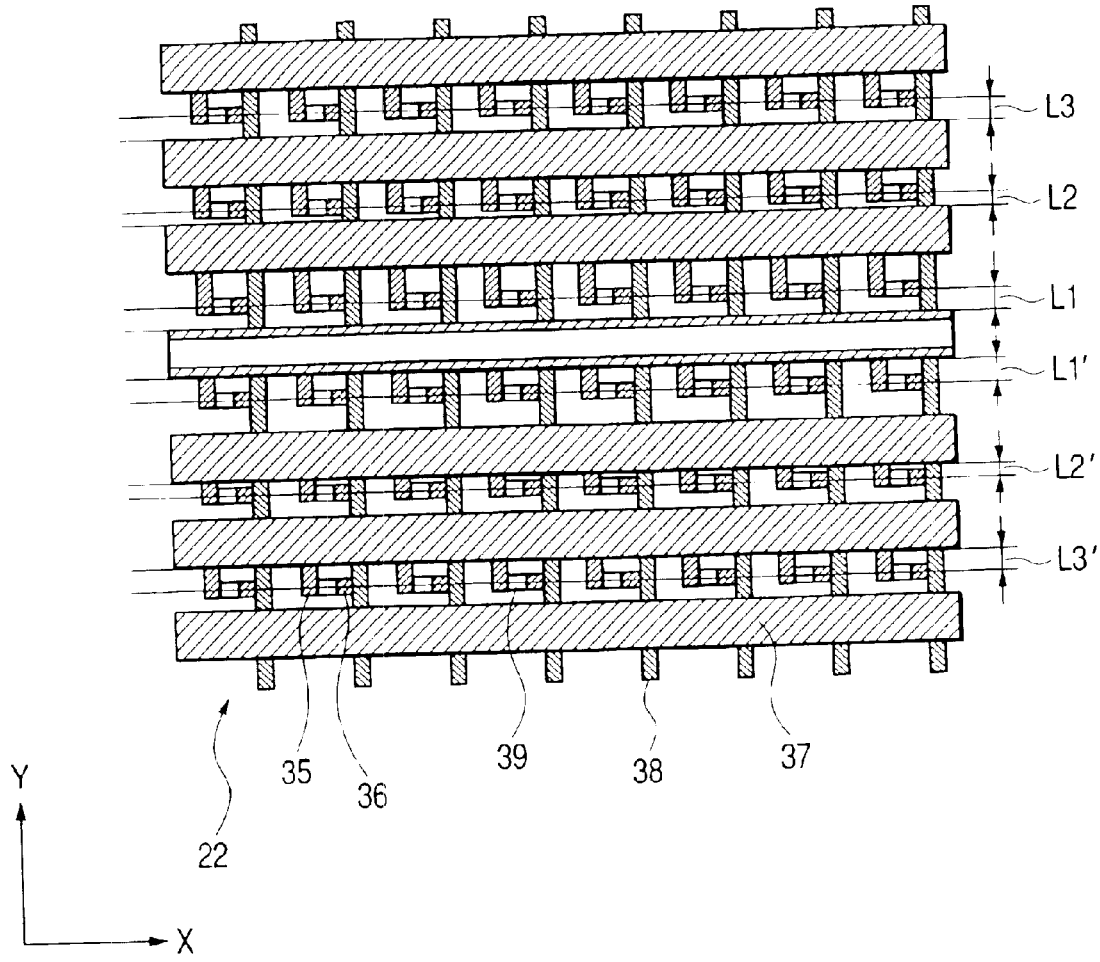
FIG. 4 is a plan view showing an example of a wiring pattern on a rear plate.

FIG. 4 shows a plan view of the rear plate 12 which has a plurality of electron-emitting devices arranged in a matrix shape. As shown in FIG. 4, in the rear plate 12, device electrodes 35 and 36, X direction wirings 37 and Y direction wirings 38 which are crossed with each other, and surface conduction electron-emitting device films (conductive films) 39 are provided on a glass substrate 22 to form electron-emitting regions 33.

The X direction wrigings 37 are arranged in a row direction and the Y direction wirings 38 are arranged in a column direction.

In addition, in this embodiment, a distance L3 is set to 170 μm, a distance L2 is set to 150 μm, and a distance L1 is set to 170 μm. A gap between the face plate 11 and the rear plate 12 is set to approximately 1.6 mm.

In the vacuum container 10, a position for forming the wiring electrode 31 on the rear plate 12 is changed, whereby the distances L1 and L2 satisfies the relationship L>L2, and deviation of a light emitting point can be controlled by correcting an electron trajectory. Thus, the display apparatus 1 can realize high quality image display.

As to the display apparatus using the spacer 17 constituted as described above, a method of manufacturing the vacuum container 10 is briefly described.

In this embodiment, a glass substrate (PD-200 manufactured by Asahi Glass Co., Ltd.) with a thickness of 2.8 mm, which contains a relatively small amount of alkaline component, was used as the glass substrates 21 and 22. In addition, on this glass substrate, a layer on which 100 nm of an $SiO_2$ film 100 was applied and baked was used as a sodium block layer.

Moreover, as the device electrodes 35 and 36, on the glass substrate 22, a titanium (Ti) layer was formed with a film thickness of 5 nm as an underlying layer by the sputtering method and a platinum (Pt) layer was formed with a film thickness of 40 nm on this titanium layer. After the laminated thin film was formed in this way, the photoresist processing was applied to the film, and a desired pattern was formed by the photolithography method consisting of a series of exposure, development, and etching processing.

In this embodiment, it was assumed that a space among device electrodes L was 10 μm and a length corresponding to the space W was 100 μm. As to the X direction wirings 37 and the Y direction wirings 38, it is desirable that the wirings have a low resistance such that a substantially uniform voltage is supplied to a large number of surface conduction electron-emitting devices 23, respectively, and a material, a film thickness, a wiring width, and the like therefor are appropriately set.

The Y direction wirings 38 serving as common wirings were formed in a line-like pattern such that the wirings is in contact with one of the device electrodes and couples the device electrodes. As a material of the Y direction wirings 38, an Ag photo-paste ink was used. After being screen printed, the material was dried, and then, exposed in a predetermined pattern and developed. Thereafter, the material was baked at a temperature around 480° C. to form a wiring.

The Y direction wirings 38 were formed with a thickness of approximately 10 μm and a width of 50 μm.

In order to insulate the X direction wirings 37 and the Y direction wirings 38, interlayer insulating layers (not shown) are arranged. With contact holes (not shown) opened in connection portions between the X direction wirings 37 and the other the device electrodes, the interlayer insulating layers were formed under the X direction wirings 37 such that crossing portions of the X direction wirings 37 and the Y direction wirings 38 formed earlier were covered and electrical connection between the X direction wirings 37 and the other device electrodes was possible.

As a process of forming the interlayer insulating layers, a photosensitive glass paste containing PbO as a main component was screen printed and then, exposed and developed. This process was repeated four times, and the photosensitive glass paste was finally baked at a temperature around 480° C. A thickness and a width of the interlayer insulating layers are approximately 30 μm in total and 150 μm, respectively.

The X direction wirings 37 were formed by screen printing an Ag paste ink on the interlayer insulating layer formed earlier, and then, dried. The same process was performed again. The Ag paste ink was applied twice in this way and baked at a temperature around 480° C. The X direction wirings 37 cross with the Y direction wirings 38 across the above-mentioned insulating films and are connected to the other device electrodes at the contact hole portion of the interlayer insulating layer.

The other device electrodes are coupled by the X direction wirings 37 and act as scanning electrodes after being paneled. The X direction wirings 37 are formed with a thickness of approximately 20 μm.

In this embodiment, the relationship L1>L2 is satisfied by changing a pitch of masks on which the Y direction wirings 38 are formed.

As described above, the XY matrix wiring is formed on the glass substrate 22.

Then, after sufficiently cleaning the glass substrate 22 on which the matrix wiring was formed, electron-emitting device films 39 were formed between the device electrodes 35 and 36 according to the inkjet application method.

Figure 7A:
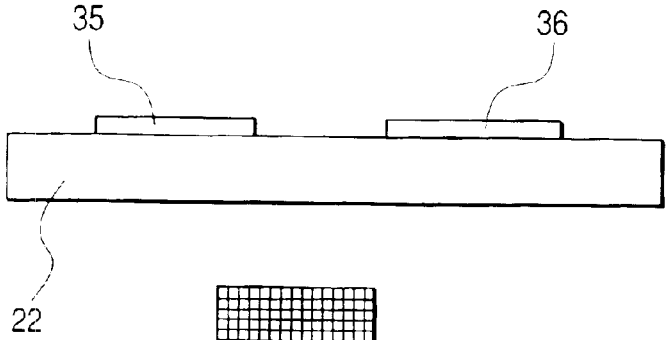
FIGS. 7A, 7B and 7C are schematic views for explaining a method of forming a device film.
Figure 7B:
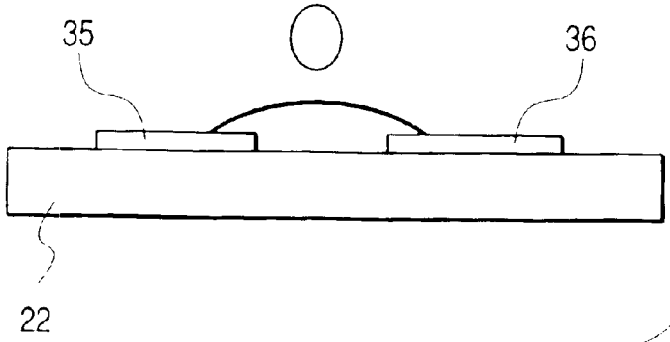
Figure 7C:
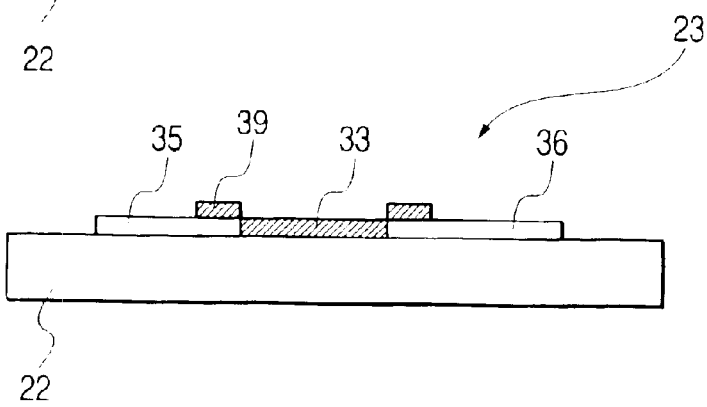

FIGS. 7A, 7B, and 7C are schematic views of a process for forming the electron-emitting device film 39.

In this embodiment, for the purpose of obtaining a palladium film as the electron-emitting device film 39, a palladium-proline complex 0.15 weight % was dissolved in a water solution consisting of 85% of water and 15% of isopropyl alcohol (IPA) to obtain an organic palladium containing solution. A slight amount of other additives were added in the solution.

Droplets of this solution were given to the part between the electrodes using an inkjet spray device with piezoelectric elements, which is adjusted to have a dot diameter of 60 μm, as droplet giving unit 48. Thereafter, this substrate was subjected to heating and baking processing for ten minutes under the temperature of 350° C. in the air to have oxide palladium (PdO). As a result, a film with a dot diameter of approximately 60 μm and a maximum thickness of 10 nm was obtained. Through this process, an oxide palladium PdO film was formed in the device portion.

Next, the forming operation will be described with reference to the drawings.

In a forming operation process, the electron-emitting device films 39 are subjected to an energization operation to cause fissures in the inside thereof and form the electron-emitting regions 33.

Figure 8A:
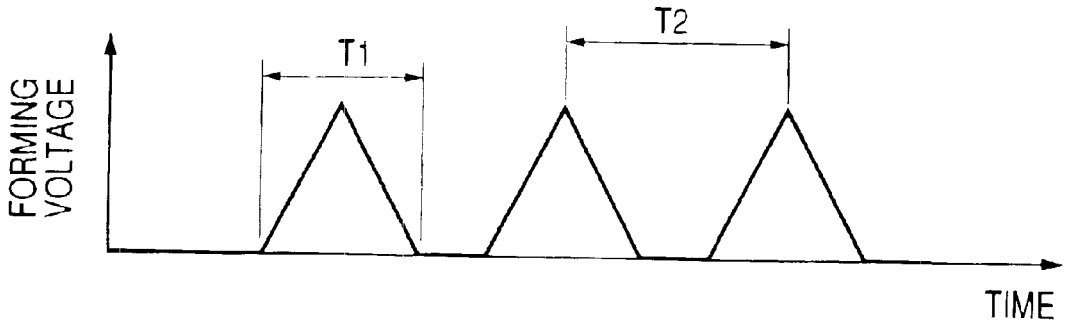
FIGS. 8A and 8B are charts for explaining a forming operation method.
Figure 8B:
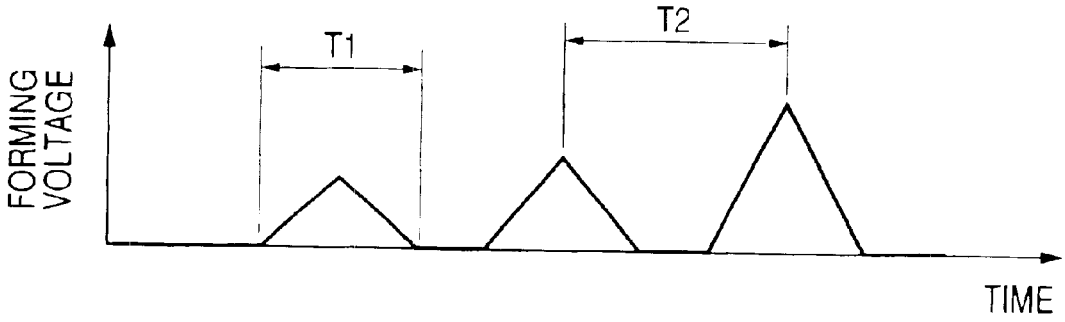

A voltage waveform used in the forming operation will be briefly described. FIGS. 8A and 8B show waveforms of a voltage in the forming operation.

In the forming operation, a voltage of a pulse waveform was applied. The pulse waveform is used as a voltage in the case in which a pulse with a constant peak value of a pulse wave is applied (see FIG. 8A) and the case in which a pulse is applied while increasing a peal value of a pulse wave (see FIG. 8B).

In FIG. 8A, a pulse width T1 of a voltage waveform is set to 1 μsec to 10 msec and a pulse interval T2 is set to 10 μsec to 100 msec, and a peak value of a triangle wave (peak voltage at the time of forming) is appropriately selected.

In FIG. 8B, sizes of the pulse width T1 and the pulse interval T2 are set to the same values as described above, a peak value of a triangle wave (peak voltage at the time of forming) is increased by, for example, approximately 0.1 V for each step.

Note that a voltage on the order of not locally destroying or deforming the electron-emitting device film 39, for example, a pulse voltage of approximately 0.1 V was inserted between forming pulses to measure a device current and a resistance value was found, and when a resistance 1000 times or more as large as a resistance before the forming operation was indicated, the forming operation was finished.

Next, the activation operation will be described with reference to the drawings.

Figure 9A:
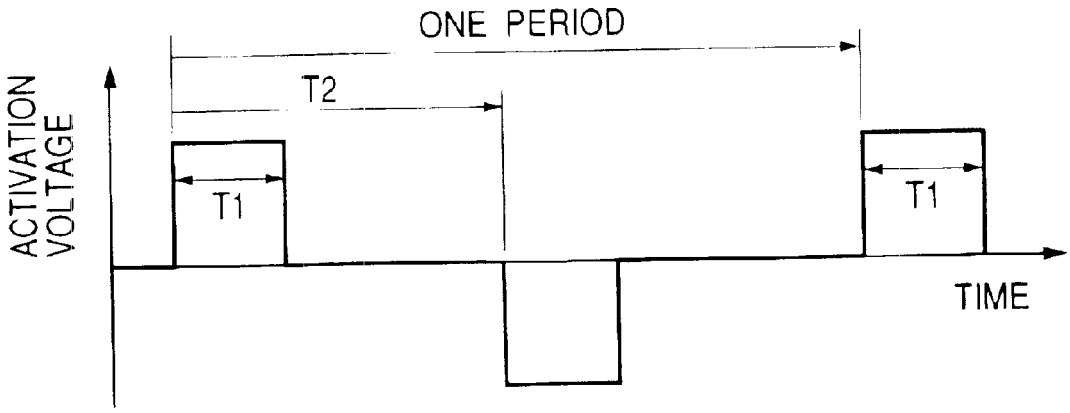
FIGS. 9A and 9B are charts for explaining an activation operation.
Figure 9B:
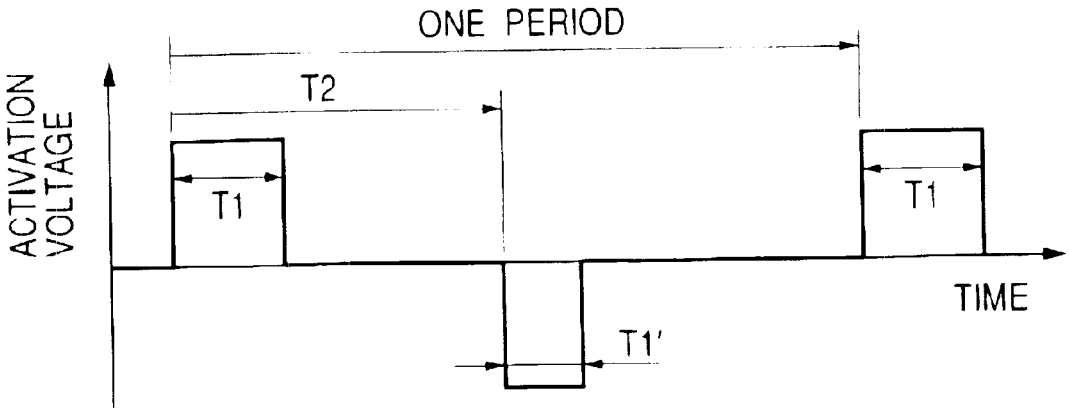

As shown in FIGS. 9A and 9B, this activation operation is a process for depositing a carbon compound as a carbon film in the vicinity of the fissures by repeatedly applying a pulse voltage to the device electrodes through the X direction wirings 37 and the Y direction wirings 38 under an appropriate vacuum degree in which organic compounds exist.

FIGS. 9A and 9B show preferable examples of voltage application used in an activation process. A maximum voltage value to be applied is appropriately selected in the range of 10 to 20 V. In FIG. 9A, reference symbol T1 denotes positive and negative pulse widths of a voltage waveform and T2 denotes a pulse interval. Absolute values of the positive and negative voltage values are set equally. In addition, in FIG. 9B, reference symbols T1 and T1' denote positive and negative pulse widths of a voltage waveform, respectively, and T2 denotes a pulse interval. Here, T1 is larger than T1' and absolute values of the positive and negative voltage values are set equally.

Figure 10:
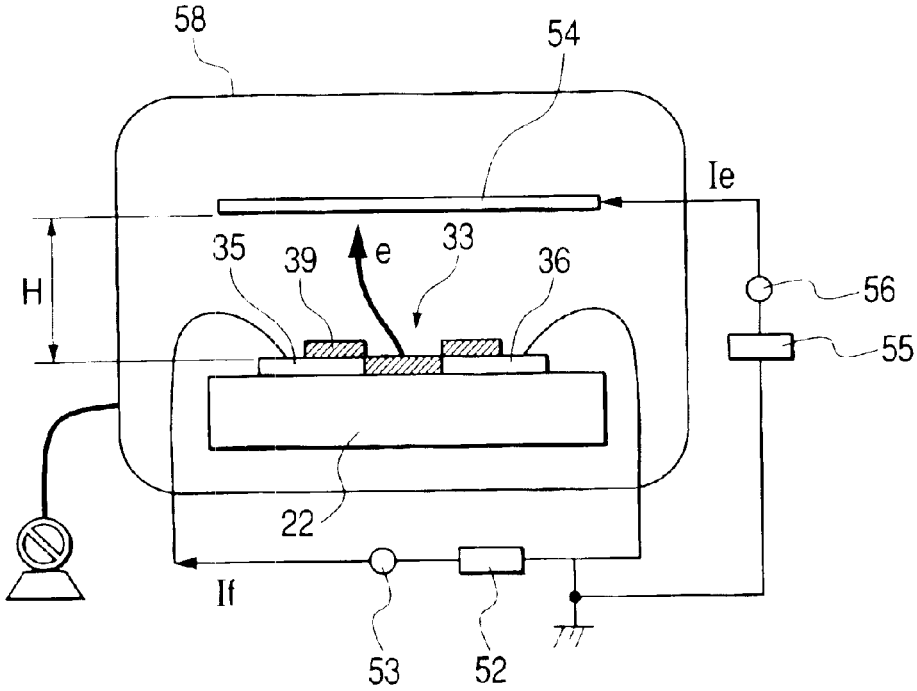
FIG. 10 is a schematic view showing a measurement and evaluation device for measuring electron emission characteristics.
Figure 11:
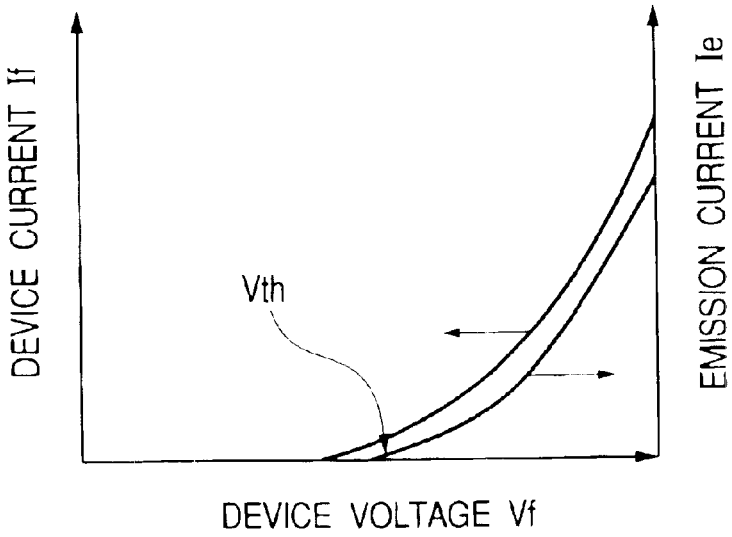
FIG. 11 is a graph showing characteristics of an electron-emitting device.

Basic characteristics of the electron-emitting device 23 produced according to the above-mentioned structure and manufacturing method will be described with reference to FIGS. 10 and 11. FIG. 10 shows a schematic view of a measurement and evaluation device 51 for measuring an electron-emitting characteristic of the electron-emitting device 23 constituted as described above. FIG. 11 shows a relationship among a device voltage Vf, a device current If and an emission current Ie.

As shown in FIG. 10, the measurement and evaluation device 51 includes a power supply 52 for applying the device voltage Vf to the device electrodes 35 and 36, an ampere meter 53 for measuring the device current If flowing through the conductive thin film 39 including the electron-emitting region 33 between the device electrodes 35 and 36, an anode electrode 54 for capturing the emission current Ie to be emitted from the electron-emitting region 33 of the device electrodes 35 and 36, a high voltage power supply 55 for applying a voltage to the anode electrode 54, and an ampere meter 56 for measuring the emission current Ie to be emitted from the electron-emitting region 33 of the device electrodes 35 and 36.

When this measurement and evaluation device 51 measures the device current If flowing between the device electrodes 35 and 36 of the electron-emitting device 23 and the emission current Ie flowing to the anode electrode 54, it electrically connects the power supply 52 and the ampere meter 53 to the device electrodes 35 and 36 and further electrically connects the anode electrode 54, the high voltage power supply 55, and the ampere meter 56 with each other.

In addition, the electron-emitting device 23 and the anode electrode 54 are installed in a vacuum chamber 58. The vacuum chamber 58 is provided with equipment necessary for a vacuum device such as not-shown exhaust pump and vacuum gauge. Further, the measurement and evaluation device 51 is constituted so as to perform measurement and evaluation of the electron-emitting device 23 under a desired vacuum. Note that a voltage of the anode electrode 54 was set to 1 kV to 10 kV and a distance H between the anode electrode 54 and the electron-emitting device is set within the range of 2 mm to 8 mm.

FIG. 11 shows a typical example of a relationship among the emission current Ie and the device current If measured by the measurement and evaluation device 51 shown in FIG. 10 and the device voltage Vf. Note that magnitudes of the emission current Ie and the device current If are different significantly. However, in FIG. 11, in order to compare and examine changes in the emission current If and the device current Ie qualitatively, vertical axes are represented by arbitrary units on a linear scale.

A specific control unit 6 provided in the display apparatus 1 will be hereinafter described with reference to the drawings. FIG. 6 shows a block diagram of a control unit for television display based on a television signal of the National Television System Committee (NTSC) system in association with a display unit which is constituted by using an electron source of a simple matrix arrangement.

As shown in FIG. 6, the control unit 6 includes a scanning circuit 41 electrically connected to the rear plate 12 side of the display unit 5, a control circuit 42 for controlling the scanning circuit 41, a shift register 43, a line memory 44, an information signal generator 45, a synchronization signal separation circuit 46, and a DC voltage source Va for supplying a voltage to the display unit 5.

An X direction driver (not shown) for applying a scanning line signal is electrically connected to the X direction wiring 37 of the display unit 5 which uses the electron-emitting device 23, and the information signal generator 45 of a Y direction driver (not shown) to which an information signal is supplied is electrically connected to the Y direction wiring 38.

In the case in which a voltage modulation system is implemented, a circuit which generates a voltage pulse of a fixed length but modules a peak value of a pulse appropriately according to data to be inputted is used as the information signal generator 45. In addition, if a pulse width modulation system is implemented, a circuit which generates a voltage pulse of a fixed peak value but modulates a width of a voltage pulse appropriately according to data to be inputted is used as the information signal generator 45.

The control circuit 42 generates control signals T scan, T sft, and T mry to the scanning circuit 41, the shift register 43, and the line memory 45, respectively, based on a synchronization signal T sync sent from the synchronization signal separation circuit 46.

The synchronization signal separation circuit 46 is a circuit for separating a synchronization signal component and a luminance signal component from a television signal of the NTSC system to be inputted from the outside. This luminance signal component is inputted in the shift register 43 synchronously with a synchronization signal.

The shift register 43 serial/parallel converts a luminance signal, which is serially inputted in time series, for example, for each line of an image and operates based on a shift clock sent from the control circuit 42. The serial/parallel converted data for one line of an image (equivalent to driving data for n electron-emitting devices) is outputted from the shift register 34 as n parallel signals.

The line memory 44 is a memory device for storing data for one line of an image only for a necessary period of time. Contents of data stored in the line memory 44 are inputted in the information signal generator 45.

The information signal generator 45 is a signal source for appropriately driving each of the electron-emitting devices 23 in response to respective luminance signals. An output signal of the information signal generator 45 enters the vacuum container 10 of the display unit 5 through the Y direction wirings 38 and is applied to the respective electron-emitting devices 23, which are located at crossing points with selected scanning lines, by the X direction wirings 37.

It becomes possible to drive the electron-emitting devices 23 on the entire surface of the rear plate 12 by sequentially scanning the X direction wirings 37.

According to the display apparatus 1 constituted as described above, a voltage is applied to the respective electron-emitting devices 23 through the X direction wirings 37 and the Y direction wirings 38 in the display unit 5, whereby electrons are emitted. Then, a high voltage is applied to the metal back 15 serving as an anode electrode through a high voltage terminal Hv, and a generated electron beam is accelerated to be collided against the fluorescent film 14, whereby various kinds of information such as an image are displayed.

Note that the above-mentioned structure of the display apparatus 1 is an example of a display apparatus to which the electron beam generation device in accordance with the present invention is applied. It is needless to mention that various modifications may be made based on the technical thought of the present invention. A signal of the NTSC system is cited as an example of an input signal. However, an input signal is not limited to this system, and other systems such as the Phase Alternation by Line (PAL) system and the High-Definition TeleVision (HDTV) system may be adopted.

Second Embodiment

A rear plate in accordance with a second embodiment will be briefly described with reference to the drawings. Note that in the rear plate of the second embodiment, the same members as those of the rear plate of the above-mentioned first embodiment are denoted by the identical reference symbols and the description thereof will be omitted for convenience' sake.

Figure 12:
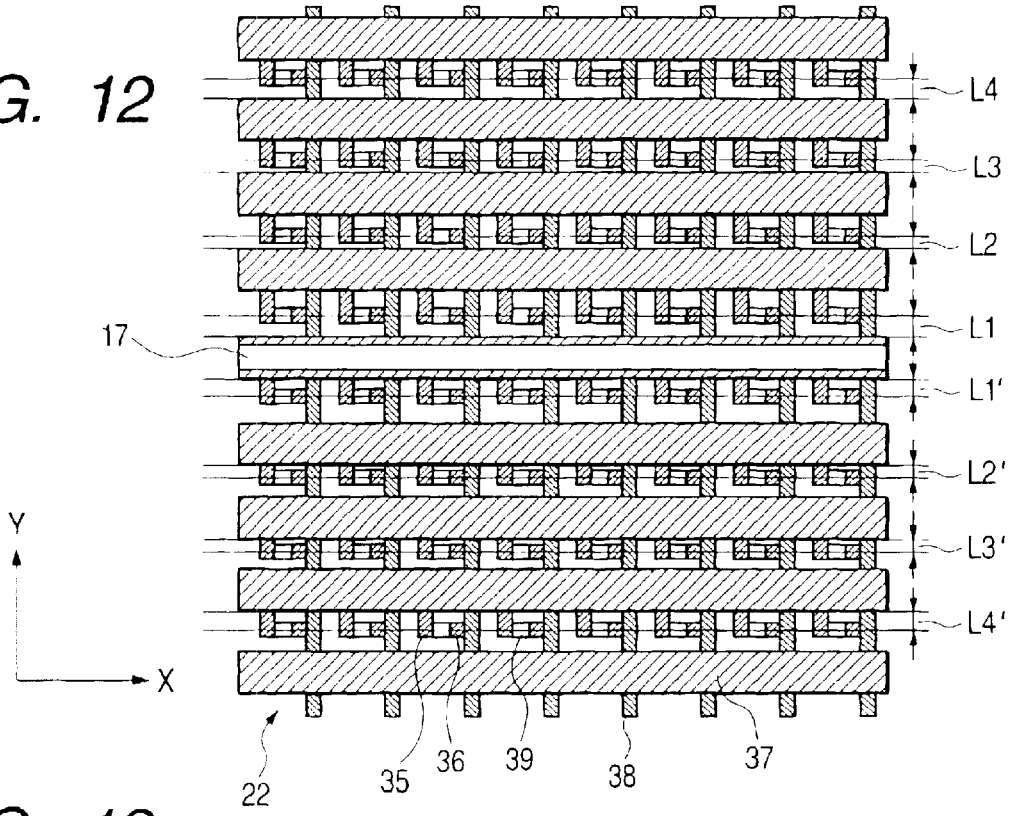
FIG. 12 is a plan view showing a wiring pattern on a rear plate of a second embodiment in accordance with the present invention.

A display apparatus of this embodiment is constituted in the same manner as that of the first embodiment except the rear plate. As shown in FIG. 12, in this embodiment, the Y direction wirings 38 were formed with a thickness of approximately 12 μm and a width of approximately 50 μm. The interlayer insulating layers were formed with a thickness of approximately 30 μm and a width of approximately 150 μm. The X direction wirings 37 were formed with a thickness of approximately 20 μm and a width of approximately 260 μm. In addition, a plurality of electron-emitting devices were formed such that a pitch of the devices was equal between any two adjacent devices. The X direction wirings 38 were formed with inter-wiring pitches varied partially such that the following relationship was realized. Consequently, emitted electrons form respective electron-emitting regions were adapted to be irradiated on a face plate section directly above the electron-emitting regions.

In this embodiment, a position where the second wiring electrode 31*b* is formed on the rear plate 12 is changed, whereby the respective distances L1 and L2 satisfy the relationship L1>L2. Further, when a distance between the second wiring electrode 31*b* and the center of the first electron-emitting region 33*a* is assumed to be S1 and a distance between the second wiring electrode 31*b* and the center of the second electron-emitting region 33*b* is assumed to be L2, the second wiring electrodes 31*b* are arranged in positions where the relationship S1>L2 is satisfied. In addition, as in the first embodiment, the second electron-emitting region 33*b* is arranged in position where the distance L2 between the second wiring electrode 31*b* and the center of the second electron-emitting region 33*b* and the distance S2 between the third wiring electrode 31*c* and the center of the second electron-emitting region 33*c* satisfy the relationship L2<S2.

Note that, in this embodiment, the distance L4 was set to 130 μm, the distance L3 was set to 115 μm, the distance L2 was set to 100 μm, and the distance L1 was set to 130 μm. The space between the opposed face plate 11 and rear plate 12 was set to approximately 1.4 mm.

According to the display apparatus provided with the rear plate of this embodiment described above, since an electron trajectory is corrected as in the above-mentioned display apparatus 1 to control deviation of a light emitting point, information such as a high quality image can be displayed.

Third Embodiment

A rear plate in accordance with a third embodiment will be briefly described with reference to the drawings. Note that, in the rear plate of the third embodiment, the same members as those of the above-mentioned rear plate are denoted by the identical reference symbols and the description thereof will be omitted for convenience' sake.

Figure 13:
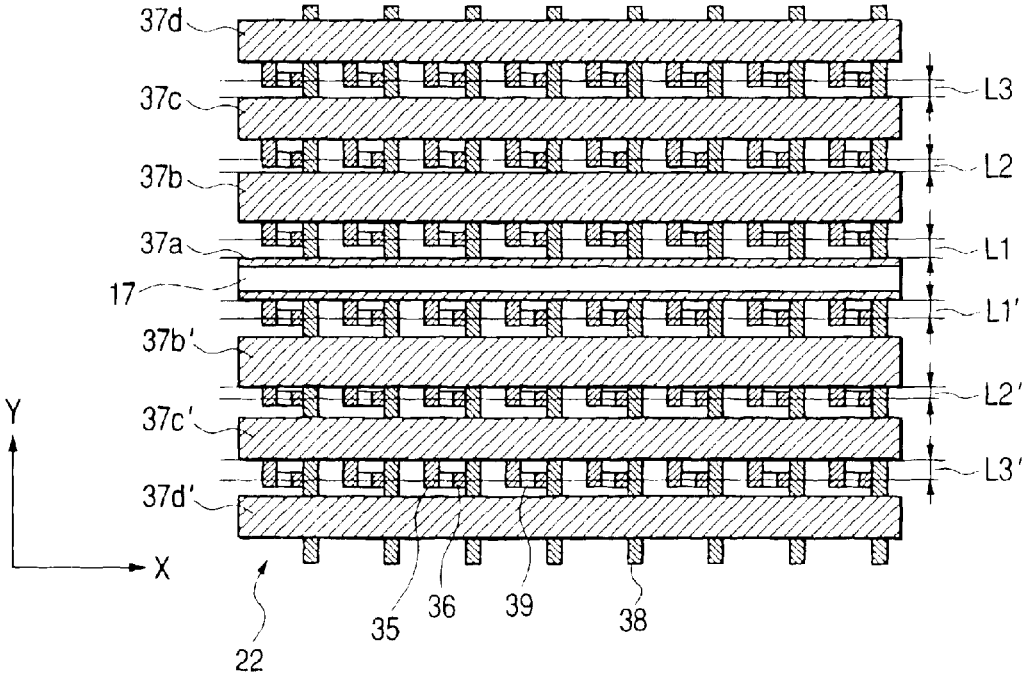
FIG. 13 is a plan view showing a wiring pattern on a rear plate of a fourth embodiment in accordance with the present invention.

A display apparatus of this embodiment is constituted in the same manner as that of the first embodiment except the rear plate. As shown in FIG. 13, in this embodiment, the Y direction wirings 38 were formed with a thickness of approximately 8 μm and a width of approximately 70 μm. The interlayer insulating layers were formed with a thickness of approximately 35 μm and a width of approximately 150 μm. The X direction wirings 37 were formed with a thickness of approximately 20 μm and a width of approximately 300 μm except the X direction wirings 37*b* and 37*b*'. The X direction wirings 37*b* and 37*b*' were formed with a width of approximately 340 μm. In addition, a plurality of electron-emitting devices were formed such that a pitch of the devices was equal between any two adjacent devices. The X direction wirings 38 were formed with inter-wiring pitches varied partially such that the following relationship was realized. Consequently, emitted electrons form respective electron-emitting regions were adapted to be irradiated on a face plate section directly above the electron-emitting regions.

In this embodiment, a width of the Y direction wirings 38 adjacent to the X direction wirings 37 with which the spacer 17 is in contact is changed, whereby the relationship L1>L2 is satisfied.

Note that, in this embodiment, the distance L3 was set to 170 μm, the distance L2 was set to 150 μm, and the distance L1 was set to 170 μm. The space between the opposed face plate 11 and rear plate 12 was set to approximately 1.5 mm.

According to the display apparatus provided with the rear plate of this embodiment described above, since an electron trajectory is corrected as in the above-mentioned display apparatus 1 to control deviation of a light emitting point, information such as a high quality image can be displayed.

Note that the application of the electron beam generation device in accordance with the present invention is not limited to a display apparatus for displaying information such as characters and images. For example, it is preferably applied to an image-forming apparatus such as a laser printer, and electron microscope, and the like.

As described above, in the image display apparatus in accordance with the present invention, spaces among a plurality of wiring electrodes are varied partially such that electrons emitted from respective electron-emitting regions of a plurality of electron-emitting devices are irradiated on an acceleration electrode portion substantially directly above the respective electron-emitting regions. Consequently, the image display apparatus can prevent positional deviation of a light emitting point from occurring. Therefore, according to this electron beam generation device, high quality display can be obtained and a high quality image can be formed.

What is claimed is:

1. An image display apparatus comprising:

a first substrate provided with an electron source which has a plurality of electron-emitting devices each having an electron-emitting region and a plurality of wiring electrodes for supplying a drive signal to the electron-emitting devices, the electron-emitting regions being arranged so as to have a substantially equal space with respect to each other;

a second substrate disposed to be opposed to the first substrate and having an acceleration electrode to which an acceleration voltage is applied and on which the electrons emitted from the electron-emitting regions arrive, the acceleration voltage acting on the emitted electrons to accelerate them; and one or more spacers disposed between the first substrate and the second substrate, the spacers being disposed on some of the plurality of wiring electrodes, wherein spaces among the plurality of wiring electrodes are partially varied so that the electrons emitted from each of the electron-emitting regions in the electron-emitting devices arrive at a region on the acceleration electrode, which is positioned substantially right above that electron-emitting region.

2. The image display apparatus according to claim 1, wherein, when a wiring electrode on which the spacer is disposed is assumed to be a first wiring electrode, a wiring electrode adjacent to the first wiring electrode is assumed to be a second wiring electrode, and a wiring electrode adjacent to the second wiring electrode in a direction apart from the spacer is assumed to be a third wiring electrode, a space W1 between the first wiring electrode and the second wiring electrode and a space W2 between the second wiring electrode and the third wiring electrode satisfy a relationship W1>W2.

3. The image display apparatus according to claim 1, wherein, when a wiring electrode on which the spacer is disposed is assumed to be a first wiring electrode, an electron-emitting region adjacent to the first wiring electrode is assumed to be a first electron-emitting region, a wiring electrode adjacent to the first wiring electrode is assumed to be a second wiring electrode, and an electron-emitting region adjacent to the second wiring electrode in a direction apart from the spacer is assumed to be a second electron-emitting region, the spaces among the plurality of wiring electrodes are partially varied in such a manner that a distance L1 between the first wiring electrode and a center of the first electron-emitting region and a distance L2 between the second wiring electrode and a center of the second electron-emitting region satisfy a relationship L1>L2.

4. The image display apparatus according to claim 1, wherein, when a wiring electrode on which the spacer is disposed is assumed to be a first wiring electrode, an electron-emitting region adjacent to the first wiring electrode is assumed to be a first electron-emitting region, a wiring electrode adjacent to the first wiring electrode is assumed to be a second wiring electrode, and an electron-emitting region adjacent to the second wiring electrode in a direction apart from the spacer is assumed to be a second electron-emitting region, the spaces among the plurality of wiring electrodes are partially varied in such a maimer that a distance S1 between the second wiring electrode and a center of the first electron-emitting region and a distance L2 between the second wiring electrode and a center of the second electron-emitting region satisfy a relationship S1>L2.

5. The image display apparatus according to claim 1, wherein, when a wiring electrode on which the spacer is disposed is assumed to be a first wiring electrode, an electron-emitting region adjacent to the first wiring electrode is assumed to be a first electron-emitting region, a wiring electrode adjacent to the first wiring electrode is assumed to be a second wiring electrode, an electron-emitting region adjacent to the second wiring electrode in a direction apart from the spacer is assumed to be a second electron-emitting region, and a wiring electrode adjacent to the second wiring electrode in a direction apart from the spacer is assumed to be a third wiring electrode, the spaces among the plurality of wiring electrodes are partially varied in such a manner that a distance L2 between the second wiring electrode and a center of the second electron-emitting region and a distance S2 between the third wiring electrode and a center of the second electron-emitting region satisfy a relationship L2<S2.

6. The image display apparatus according to claim 1, wherein, when a wiring electrode on which the spacer is disposed is assumed to be a first wiring electrode, a wiring electrode adjacent to the first wiring electrode is assumed to be a second wiring electrode, a width of the second wiring electrode is larger than a width of the first wiring electrode.

7. The image display apparatus according to claim 1, wherein the plurality of electron-emitting devices are surface conduction electron-emitting devices that are provided with a pair of device electrodes opposed to each other and a thin film which has an electron-emitting region and is provided between the device electrodes.

8. The image display apparatus according to claim 7, wherein a plurality of row-directional wirings and column-directional wirings for supplying an electric current to the device electrodes are disposed on the electron source via an insulating layer, and the pair of device electrodes are connected to the row-directional wirings and the column-directional wirings, whereby the plurality of electron-emitting devices are arranged in a matrix shape on an insulating substrate.

9. An image display apparatus comprising:

a first substrate provided with an electron source which has a plurality of electron-emitting devices, each having an electron-emitting region and a plurality of wiring electrodes for supplying a drive signal to the electron-emitting devices, the electron-emitting regions being arranged so as to have a substantially equal space with respect to each other;

a second substrate having a plurality of image forming members which correspond to the plurality of electron-emitting devices, respectively, each of the image forming members being irradiated with electrons emitted from the electron emitting region of a corresponding electron-emitting device, the plurality of image forming members being arranged so as to have a substantially equal space with respect to each other; and one or more spacers disposed between the first substrate and the second substrate, the spacers being disposed on some of the plurality of wiring electrodes, wherein at least one spacer adapts to form a distribution of electric potential on a surface thereof so as to cause the electrons emitted from an electron-emitting device close to the at least one spacer to be deviated in a direction apart from the at least one spacer on a side of the electron source and to cause same electrons to be deviated in a direction close to the at least one spacer on a side of the image forming members, and wherein spaces among the plurality of wiring electrodes are partially different so that the electrons emitted from each of the electron-emitting regions of the electron-emitting devices arrive on one of the image forming members corresponding to that electron-emitting device.

10. The image display apparatus according to claim 9, wherein each of the spacers comprises an insulating member and a resistance film deposited on a surface of the insulating member, a resistivity of the resistance film is lower than that of the insulating member, and the resistance film is electrically connected to the electron source and the image forming members.

11. The image display apparatus according to claim 10, wherein a surface resistance of the resistance film is in a range of $10^7$ to $10^{14}$ Ω/□.

12. The image display apparatus according to claim 9, wherein, when a wiring electrode on which a spacer is disposed is assumed to be a first wiring electrode, a wiring electrode adjacent to the first wiring electrode is assumed to be a second wiring electrode, and a wiring electrode adjacent to the second wiring electrode in a direction apart from at least one spacer is assumed to be a third wiring electrode, a space W1 between the first wiring electrode and the second wiring electrode and a space W2 between the second wiring electrode and the third wiring electrode satisfy a relationship W1>W2.

13. The image display apparatus according to claim 9, wherein, when a wiring electrode on which a spacer is disposed is assumed to be a first wiring electrode, a wiring electrode adjacent to the first wiring electrode is assumed to be a second wiring electrode, a width of the second wiring electrode is larger than a width of the first wiring electrode.

14. An image display apparatus comprising:

a first substrate provided with a plurality of electron-emitting devices, each having an electron-emitting region and a plurality of electroconductive members disposed so as to correspond to the plurality of electron-emitting devices, respectively, wherein the electron-emitting regions are arranged so as to have a substantially equal space with respect to each other in at least one direction and wherein the plurality of electroconductive members are capable of affecting an orbit of each electron emitted from the electron-emitting regions, a second substrate having a plurality of luminous members which correspond to the plurality of electron-emitting devices, respectively, each of the luminous members being irradiated with electrons emitted from the electron emitting region of a corresponding electron-emitting device, the plurality of luminous members being arranged so as to have a substantially equal space with respect to each other in the at least one direction; and one or more spacers disposed between the first substrate and the second substrate, wherein at least one spacer can provide a distribution of electric potential on a surface thereof so as to cause the electrons emitted from an electron-emitting device close to the at least one spacer to be deviated, and wherein spaces among the plurality of electroconductive members are partially different along the at least one direction so that the electrons emitted from each of the electron-emitting regions of the electron-emitting devices arrive on one of the luminous members corresponding to that electron-emitting device.

15. The image display apparatus according to claim 14, wherein the spacers are disposed on some of the plurality of electroconductive members, and wherein, when an electroconductive member on which a spacer is disposed is assumed to be a first electroconductive member, an electroconductive member adjacent to the first electroconductive member is assumed to be a second electroconductive member, and an electroconductive member adjacent to the second electroconductive member in a direction apart from the spacer is assumed to be a third electroconductive member, a space W1 between the first electroconductive member and the second electroconductive member and a space W2 between the second electroconductive member and the third electroconductive member satisfy a relationship W1>W2.

16. The image display apparatus according to claim 14, wherein the spacers are disposed on some of the plurality of electroconductive members, and wherein, when an electroconductive member on which a spacer is disposed is assumed to be a first electroconductive member, and an electroconductive member adjacent to the first electroconductive member is assumed to be a second electroconductive member, a width of the second electroconductive member is longer than a width of the first electroconductive member.

17. An image display apparatus comprising:

a first substrate which has a plurality of electron-emitting areas and a plurality of electroconductive members disposed so as to correspond to the plurality of electron-emitting areas, respectively, wherein the electron-emitting areas are arranged so as to have a substantially equal space with respect to each other in at least one direction and wherein the plurality of electroconductive members are capable of affecting an orbit of each electron emitted from the electron-emitting areas;

a second substrate having a plurality of luminous members which correspond to the plurality of electron-emitting areas, respectively, each of the luminous members being irradiated with electrons emitted from a corresponding area, the plurality of luminous members being arranged so as to have a substantially equal space with respect to each other in the at least one direction; and one or more spacers disposed between the first substrate and the second substrate, wherein at least one spacer can provide a distribution of electric potential on a surface thereof so as to cause the electrons emitted from an electron-emitting area close to the at least one spacer to be deviated, and wherein spaces among the plurality of electroconductive members are partially different along the at least one direction so that the electrons emitted from each of the electron-emitting areas of the electron-emitting devices arrive on one of the luminous members corresponding to that electron-emitting area.

18. The image display apparatus according to claim 17, wherein the spacers are disposed on some of the plurality of electroconductive members, and wherein, when an electroconductive member on which a spacer is disposed is assumed to be a first electroconductive member, an electroconductive member adjacent to the first electroconductive member is assumed to be a second electroconductive member, and an electroconductive member adjacent to the second electroconductive member in a direction apart from the spacer is assumed to be a third electroconductive member, a space W1 between the first electroconductive member and the second electroconductive member and a space W2 between the second electroconductive member and the third electroconductive member satisfy a relationship W1>W2.

19. The image display apparatus according to claim 17, wherein the spacers are disposed on some of the plurality of electroconductive members, and wherein, when an electroconductive member on which a spacer is disposed is assumed to be a first electroconductive member, and an electroconductive member adjacent to the first electroconductive member is assumed to be a second electroconductive member, a width of the second electroconductive member is longer than a width of the first electroconductive member.

20. An image display apparatus comprising:

at least one spacer;

a plurality of electron-emitting regions having at least first electron-emitting regions and second electron-emitting regions, distances between electron-emitting regions adjacent to each other of the plurality of electron-emitting regions being substantially equal, the first electron-emitting regions being close to the at least one spacer, the second electron-emitting regions being father from the least one spacer than the first electron-emitting regions;

a plurality of wirings each interposed between adjacent electron-emitting regions; and a plurality of luminous members, distances between luminous members adjacent to each other of the plurality of luminous members being substantially equal, wherein a distance between wirings adjacent to each other sandwiching one of the first electron-emitting regions is different from a distance between wirings adjacent to each other sandwiching one of the second electron-emitting regions so that irradiated positions on the luminous members are aligned so as to allow distances between adjacent irradiated positions to be substantially equal, each of the irradiated positions being a position at which each of the plurality of luminous members is irradiated with electrons emitted from a corresponding electron-emitting region of the plurality of electron-emitting regions.

21. An image display apparatus comprising:

a first substrate provided with a plurality of electron emitting devices, each having an electron-emitting region and a plurality of electroconductive members disposed so as to sandwich each of the plurality of electron-emitting devices between two adjacent electroconductive members in at least one direction, wherein distances between electron-emitting regions adjacent to each other of the plurality of electron-emitting regions are substantially equal in the at least one direction, a second substrate having a plurality of luminous members, each of the luminous members being irradiated with electrons emitted from the electron emitting region of at least one of the plurality of electron-emitting devices, wherein distances between luminous members adjacent to each other of the plurality of luminous members are substantially equal in the at least one direction; and one or more spacers disposed between the first substrate and the second substrate, and wherein distances between electroconductive members adjacent to each other of the plurality of electroconductive members are partially different along the at least one direction so that the electrons emitted from each of the electron-emitting regions of the electron-emitting devices arrive at regions on the luminous members, wherein distances between regions adjacent to each other are substantially equal in the at least one direction.

22. The image display apparatus according to claim 21, wherein the spacers are disposed on some of the plurality of electroconductive members, and wherein, when an electroconductive member on which a spacer is disposed is assumed to be a first electroconductive member, an electroconductive member adjacent to the first electroconductive member is assumed to be a second electroconductive member, and an electroconductive member adjacent to the second electroconductive member in a direction apart from the spacer is assumed to be a third electroconductive member, a space W1 between the first electroconductive member and the second electroconductive member and a space W2 between the second electroconductive member and the third electroconductive member satisfy a relationship W1<W2.

23. The image display apparatus according to claim 21, wherein the spacers are disposed on some of the plurality of electroconductive members, and wherein, when an electroconductive member on which a spacer is disposed is assumed to be a first electroconductive member, and an electroconductive member adjacent to the first electroconductive member is assumed to be a second electroductive member, a width of the second electroconductive member is longer than a width of the first electroconductive member.

* * * * *

UNITED STATES PATENT AND TRADEMARK OFFICE

CERTIFICATE OF CORRECTION

PATENT NO. : 6,992,447 B2
APPLICATION NO. : 10/375194
DATED : January 31, 2006
INVENTOR(S) : Masahiro Fushimi et al.

It is certified that error appears in the above-identified patent and that said Letters Patent is hereby corrected as shown below:

COLUMN 1

Line 46, “causes” should read --the causes--; and
Line 51, “deposit” should read --deposited--.

COLUMN 3

Line 5, “such” should read --in such--
Line 20, “such” should read --in such--;
Line 37, “such” should read --in such--; and
Line 53, “layers,” should read --layer,--.

COLUMN 6

Line 10, “reason,” should read --reason--;
Line 12, “electrodes,” should read --electrodes--; and
Line 15, “from that” should read --from the fact that--.

COLUMN 9

Line 32, “quarts” should read --quartz--; and
Line 67, “resistivity p” should read --resistivity ρ--.

UNITED STATES PATENT AND TRADEMARK OFFICE

CERTIFICATE OF CORRECTION

PATENT NO. : 6,992,447 B2
APPLICATION NO. : 10/375194
DATED : January 31, 2006
INVENTOR(S) : Masahiro Fushimi et al.

It is certified that error appears in the above-identified patent and that said Letters Patent is hereby corrected as shown below:

COLUMN 10

Line 11, “because,” should read --because--;
Line 41, “wrigings” should read --wirings--; and
Line 50, “satisfies” should read --satisfy--.

COLUMN 11

Line 15, “wirings is” should read --wirings are--; and
Line 29, “other the” should read --other--.

COLUMN 12

Line 28, “peal value” should read --peak value--.

COLUMN 14

Line 7, “modules” should read --modulates--.

COLUMN 15

Line 8, “convenience” should read --convenience’s--
Line 23, “form” should read --from--;
Line 37, “position” should read --a position--; and
Line 59, “convenience”’ should read --convenience’s--.

UNITED STATES PATENT AND TRADEMARK OFFICE

CERTIFICATE OF CORRECTION

PATENT NO. : 6,992,447 B2
APPLICATION NO. : 10/375194
DATED : January 31, 2006
INVENTOR(S) : Masahiro Fushimi et al.

It is certified that error appears in the above-identified patent and that said Letters Patent is hereby corrected as shown below:

COLUMN 16

Line 8, “form” should read --from--.

COLUMN 17

Line 39, “maimer” should read --manner--.

COLUMN 19

Line 26, “regions,” should read --regions;--.

COLUMN 21

Line 7, “father” should read --farther--;“least” should read --at least--; and
Line 37, “direction,” should read --direction;--.

COLUMN 22

Line 31, “W1<W2.” should read --W1>W2.--; and
Line 39, “electroductive” should read --electroconductive--.

Signed and Sealed this

Tenth Day of October, 2006

JON W. DUDAS
*Director of the United States Patent and Trademark Office*